US006786209B2

(12) United States Patent
Stewart

(10) Patent No.: US 6,786,209 B2
(45) Date of Patent: Sep. 7, 2004

(54) AUXILIARY POWER UNIT EXHAUST SYSTEM AND METHOD FOR A LOCOMOTIVE

(75) Inventor: Ted E. Stewart, Jacksonville, FL (US)

(73) Assignee: CSXT Intellectual Properties Corporation, Jacksonville, FL (US)

( * ) Notice: Subject to any disclaimer, the term of this patent is extended or adjusted under 35 U.S.C. 154(b) by 0 days.

(21) Appl. No.: 10/305,144

(22) Filed: Nov. 27, 2002

(65) Prior Publication Data

US 2004/0099256 A1 May 27, 2004

(51) Int. Cl.[7] ..... F02M 25/07

(52) U.S. Cl. ..... 123/568.11; 123/568.12; 123/142.5 R; 60/605.2

(58) Field of Search ..... 123/568.11, 568.12, 123/3, 142.5 R, 142.5 E; 701/101–103, 108, 112, 114, 115; 60/605.2

(56) References Cited

U.S. PATENT DOCUMENTS 5,456,240 A * 10/1995 Kanesaka ..... 123/568.11
5,517,976 A * 5/1996 Bachle et al. ..... 123/568.11
6,138,650 A * 10/2000 Bailey ..... 123/568.11
6,470,844 B2 10/2002 Biess ..... 123/142.5 R
6,636,798 B2 * 10/2003 Biess et al. ..... 701/112

OTHER PUBLICATIONS

Tomazic, "A Primer on Exhaust Gas Recirculation," Diesel Progress North American Edition, Oct. 2001, pps. 26, 28–30.

* cited by examiner

*Primary Examiner*—Willis R. Wolfe, Jr.
(74) *Attorney, Agent, or Firm*—Pillsbury Winthrop LLP

(57) ABSTRACT

Systems and methods for reducing engine emissions in a locomotive are presented. In an embodiment, the primary engine of a locomotive has an associated auxiliary power unit (APU). Exhaust from the APU is directed into an air intake system of the primary engine. The APU may be selectively operated based on a current operating condition of the locomotive.

45 Claims, 7 Drawing Sheets

AUXILIARY POWER UNIT EXHAUST SYSTEM AND METHOD FOR A LOCOMOTIVE

BACKGROUND

1. Field

Embodiments of the present invention relate to systems and methods for reducing engine emissions in a locomotive.

2. Description of Related Art

Locomotive manufacturers and remanufacturers supply locomotive diesel engines to the rail transportation industry, which includes establishments furnishing transportation by line-haul railroad, as well as switching and terminal establishments. In recent years, Environmental Protection Agency (EPA) emissions standards for locomotive diesel engines have become increasingly demanding. In particular, standards enacted under the Federal Clean Air Act of 1998 require significant reductions of individual emission compounds, including oxides of nitrogen ($NO_x$). $NO_x$ gases, which include the compounds nitrogen oxide (NO) and nitrogen dioxide ($NO_2$), are a major component of smog and acid rain.

Exhaust from a locomotive diesel engine includes various gaseous constituents, such as $NO_x$, carbon monoxide (CO), carbon dioxide ($CO_2$), and hydrocarbons (HC), as well as particulate matter. Severe environmental and economic consequences may ensue if locomotive engine emissions do not comply with applicable EPA standards.

U.S. Pat. No. 6,470,844 to Biess et al. discloses a system and method that automatically shuts down a primary engine of a locomotive after the primary engine has been idling for a predetermined period of time. A small secondary engine is started to perform useful functions on behalf of the shutdown primary engine. Because it reduces locomotive idle time, this approach reduces engine emissions. However, engine emissions remain a cause for concern when the primary engine is running.

Therefore, what is needed is a system and method for reducing engine emissions in a locomotive.

DETAILED DESCRIPTION

Systems and methods for a large engine, such as a diesel engine in a locomotive, are presented. In various embodiments, the primary engine of a locomotive has an associated auxiliary power unit (APU). The primary engine and APU are simultaneously operated, or the primary engine is shut down. Exhaust from the APU is directed into an air intake system of the primary engine. In some embodiments, the APU may be selectively operated, such as via a controller. Alternatively or additionally, the APU exhaust may be selectively directed into the air intake system, such as via a controller.

As such, locomotive engine emissions may be reduced, and APU performance improved.

Figure 1:
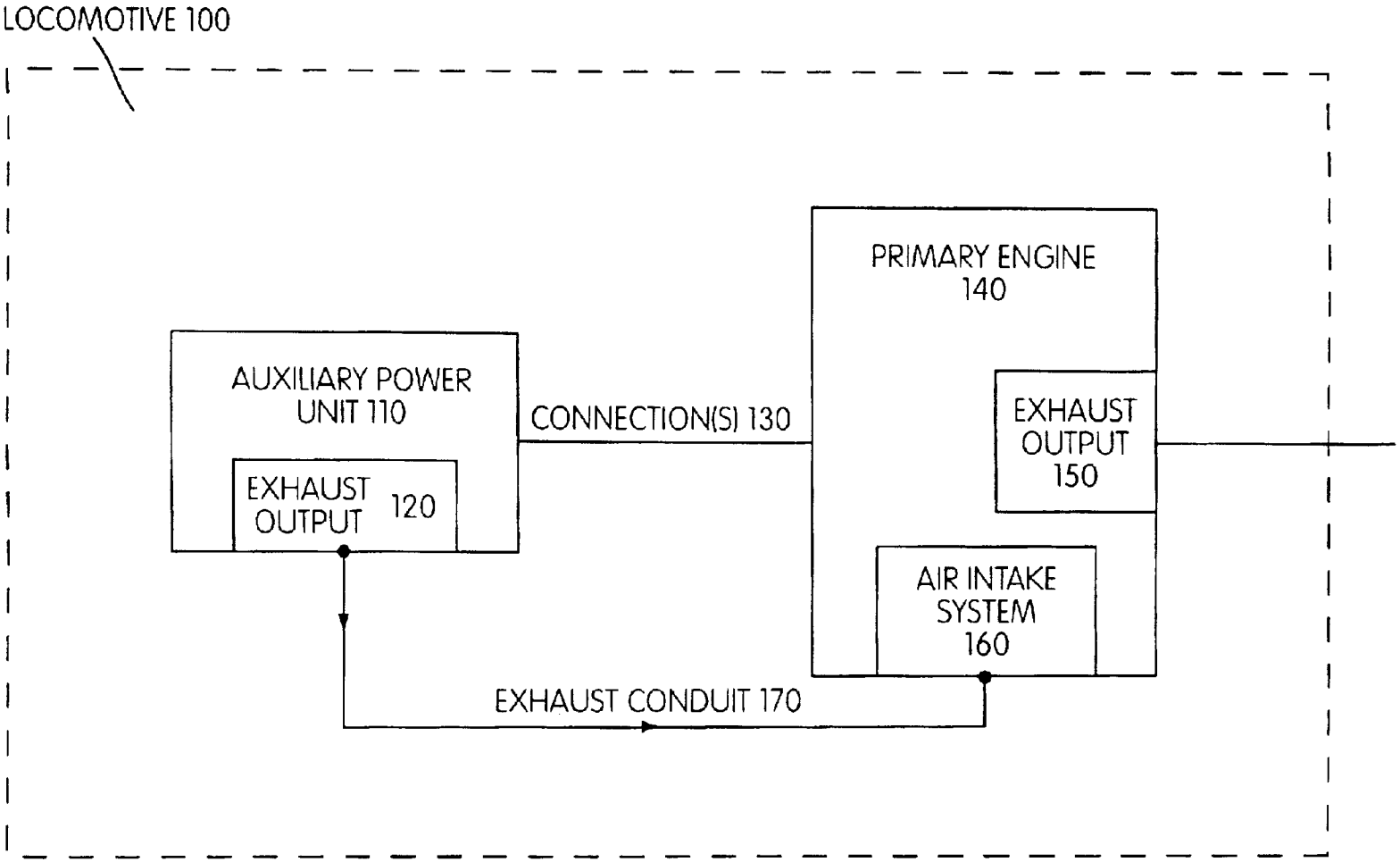
FIG. 1 is a block diagram of a locomotive according to an embodiment of the present invention.

FIG. 1 is a block diagram of a locomotive 100 according to an embodiment of the present invention. In an exemplary implementation, locomotive 100 is a diesel-electric locomotive in which a diesel engine drives a generator that produces electric power, which in turn runs electric motors that turn driving wheels of the locomotive. For instance, locomotive 100 may be an AC4400 CW™ locomotive manufactured by GE Transportation Systems.

Locomotive 100 includes a primary engine 140 and an auxiliary power unit (APU) 110. Primary engine 140 may be mounted in locomotive 100 in accordance with the art. APU 110 may be removably or rigidly mounted in a suitable location in locomotive 100, such as, for example, behind the air compressor in the radiator compartment of the locomotive, on or near the fuel tank under the locomotive platform, on a walkway of the locomotive, or inside the body of the car of the locomotive. In a particular embodiment, APU 110 slides via tracks into a cavity formed in the fuel tank. In some embodiments, locomotive 100 may be retrofitted with APU 110 after manufacturing of locomotive 100. In other embodiments, locomotive 100 may include multiple APUs 110.

Primary engine 140 is an engine, such as a diesel engine, that drives a generator (not shown) to run electric motors associated with turning wheels of locomotive 100. For example, primary engine 140 may comprise a 16-cylinder, 4,400 horsepower (HP) engine.

Primary engine 140 includes an air intake system 160 and exhaust output 150. Air intake system 160 receives gases, such as gaseous constituents of air, for use by primary engine 140 during a combustion process employed in primary engine 140. Air intake system 160 may be naturally aspirated or may include one or more suction mechanisms, such as a turbocharger, a supercharger, or engine blowers, to draw in gases for such use. Exhaust output 150 discharges exhaust produced by primary engine 140 as a byproduct of combustion. Such exhaust may be released into the atmosphere and/or recirculated into air intake system 160 of primary engine 140 in some embodiments.

APU 110 provides electric power for use by devices internal or external to locomotive 100. In a particular embodiment, APU 110 includes a diesel engine (not shown) coupled to an electrical generator (not shown). The APU engine may be, for example, a turbo-charged, 4-cylinder diesel engine, such as a 40 HP engine. The APU engine may be chosen based in part on the amount of exhaust flow produced by the APU engine; with sufficient exhaust flow, a combustion process in primary engine 140 may be appreciably altered, as discussed below. The electrical generator may be, for example, a 17 kva, 240 vac/60 Hz single-phase generator that is coupled to the APU engine.

APU 110 may be coupled to primary engine 140 via one or more connection(s) 130. Connection(s) 130 may include, for example, fuel, electrical, coolant, lube oil, and/or control connections. In some embodiments, APU 110 may draw fuel directly from a fuel tank of primary engine 140. Alternatively or additionally, APU 110 may recirculate and/or heat lube oil or coolant of primary engine 140. Via an electrical generator, APU 110 may charge batteries of locomotive 100 or provide power to other devices when APU 110 is running. In particular, APU 110 may power cab heaters and/or air conditioners (not shown) of locomotive 100.

In one embodiment, APU 110, via a control connection 130 to primary engine 140, initiates shutdown of primary engine 140. For instance, if primary engine 140 idles for a predetermined period of time, such as fifteen minutes, APU 110 may transmit a control signal to cause primary engine 140 to shut down. APU 110 may include or access an engine idle timer to determine when to initiate shutdown of primary engine 140. Shutdown of primary engine 140 may be conditioned upon various other factors, such as locomotive battery voltage, ambient temperature, coolant temperature, and brake pressure. Alternatively or additionally, APU 110 may transmit a control signal to cause primary engine 140 to start up. Engine control functions may be performed by one or more controllers, as described below.

In exemplary embodiments of the present invention, APU 110 is implemented in accordance with various apparatus and/or methods disclosed in U.S. Pat. No. 6,470,844 to Biess et al., entitled "SYSTEM AND METHOD FOR SUPPLYING AUXILIARY POWER TO A LARGE DIESEL ENGINE." However, it is to be appreciated that other apparatus and methods may be employed consistent with embodiments of the present invention.

APU 110 includes an exhaust output 120. Exhaust output 120 may discharge exhaust produced by an engine of APU 110.

As shown in FIG. 1, exhaust output 120 of APU 110 is connected to air intake system 160 of primary engine 140 via an exhaust conduit 170. Conduit 170 may include one or more members, such as rigid or flexible pipes, hoses, and ducts. Conduit 170 conveys at least a portion of APU exhaust from exhaust output 120 of APU 110 to air intake system 160 of primary engine 140. Thus, APU exhaust is directed into air intake system 160 and into primary engine 140, thus affecting the combustion process in primary engine 140 and emission levels of primary engine 140.

Exhaust output 120 of APU 110 may push APU exhaust towards air intake system 160, which may draw in the APU exhaust via natural aspiration or via suction mechanisms, such as turbochargers, superchargers, or blowers. APU fuel performance may be improved by such drawing in of APU exhaust.

Air intake system 160 of primary engine 140 may receive gases from multiple sources. For instance, air intake system 160 may receive APU exhaust, as well as air from the atmosphere outside of locomotive 100. In an exemplary implementation, air intake system 160 receives about 10 percent APU exhaust, and 90 percent air.

Figure 2:
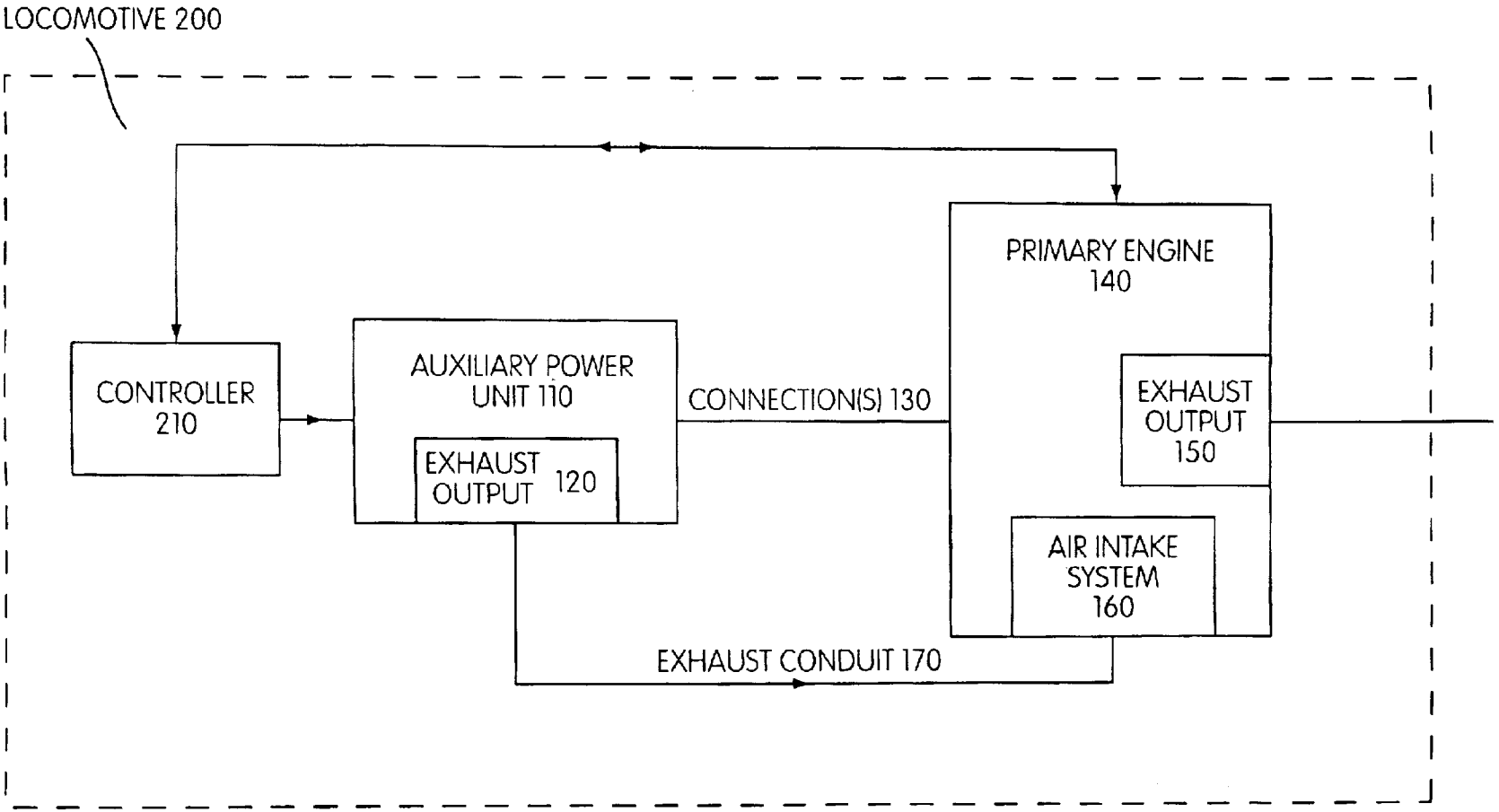
FIG. 2 is a block diagram of a locomotive according to an embodiment of the present invention.

FIG. 2 is a block diagram of a locomotive 200 according to another embodiment of the present invention. Locomotive 200 is similar to locomotive 100 of FIG. 1. Locomotive 200 includes a controller 210 in addition to APU 110 and primary engine 140, which are described above.

Controller 210 is coupled to APU 110. Controller 210 may be implemented in software, hardware, firmware, and/or hardwired circuitry. Although controller 210 is depicted in FIG. 2 as a discrete device, it is to be appreciated that controller 210 may be integrated within APU 110 or primary engine 140. In some embodiments, controller 210 may be controlled by a remote control device (not shown) located outside of locomotive 200 and communicating via wireless means, such as radio frequency (RF) means. In a particular embodiment, a remote controller located in a mobile device or ground station may issue commands, such as user-inputted commands, to respectively start and shut down APU 110. Controller 210 may include a logger to log APU status and/or primary engine status with respect to time. In related embodiments, real-time status information concerning APU 110 and primary engine 140 is transmitted to a receiver remote from locomotive 200.

In other embodiments, a laptop (not shown) may interface with an input of controller 210, APU 110, and/or primary engine 140. The laptop may download information from, or upload information to, controller 210, APU 110, and/or primary engine 140. Information may include real-time and/or logged status information, as well as user-inputted information. In some embodiments, controller 210, APU 110, and/or primary engine 140 may be interfaced with the Internet and/or one or more intranets. In an exemplary implementation, a World Wide Web (WWW) browser at a client computer, such as a laptop, may be used to access and/or control controller 210, APU 110, and/or primary engine 140.

Controller 210 selectively operates APU 110. In particular, controller 210 may start APU 110 or shut down APU 110. In an exemplary implementation, controller 210 starts or shuts down APU 110 based on one or more detected operating conditions, including particular values or ranges thereof. Exemplary operating conditions may include a current throttle or notch setting of locomotive 200, temperature and/or pressure of intake air in the manifold of primary engine 140, temperature and/or pressure of exhaust of primary engine 140, and whether primary engine 140 is running or not running. When APU 110 and primary engine 140 are running, APU exhaust from exhaust output 120 may be directed via exhaust conduit 170 into air intake system 160 of primary engine 140.

Running APU 110 while primary engine 140 of locomotive 200 is running, and directing APU exhaust into primary engine 140, may reduce emission levels outputted by primary engine 140 for one or more operating conditions thereof. Controller 210 may cycle APU 110 on and off as operating conditions of locomotive 200 change. Alternatively, APU 110 may constantly run without regard to operating conditions, such that, for example, APU 110 provides electrical power for performance-enhancing functions, such as powering a refrigeration unit and cooling off air of primary engine 140.

In an embodiment, if running APU 110 while primary engine 140 is running is demonstrated to result in a decrease in emission levels for one or more operating conditions, then controller 210 may detect when such conditions are satisfied, and thus start APU 110. When such conditions of primary engine 140 are no longer satisfied, then controller 210 may detect the change and shut down APU 110.

For instance, if emission levels of $NO_x$ decrease for notches 2 and 4, then controller 210 may detect when primary engine 140 enters either of these two notches, and thus start APU 110. When a notch setting changes to a setting other than 2 or 4, then controller 210 may detect the change and shut down APU 110.

Detection of notch settings may be accomplished in various ways. For example, one or more governor signals of primary engine 140 may be tapped. Based on solenoids activated by the governor signal(s), it may be determined in which notch primary engine 140 is operating. In other embodiments, a speed sensor on the flywheel of primary engine 140 may be employed, or temperature and/or pressure of exhaust of primary engine 140 may be sensed to determine a notch setting.

Accordingly, in accordance with various embodiments of the present invention, APU 110 may be run concurrently with running of primary engine 140 at times when APU 110 is not needed to perform functions, such as power generation functions, on behalf of primary engine 140.

The effects of directing APU exhaust into the air intake system of a primary engine may be specific to particular locomotives. Such effects may be readily determined by measuring emission levels when APU exhaust is channeled into a primary engine and counterpart levels when such exhaust is not channeled, and comparing the levels. Throttle settings and other conditions may be varied during testing to determine operating conditions, such as throttle or notch settings, temperatures, and/or pressures, for which the directed APU exhaust results in decreased emission levels. Controller 210 may then be configured to start APU 110 when such operating conditions of primary engine 140 are satisfied. Such configuration may be static or dynamic. For example, in an embodiment, controller 210 may start APU 110 in response to user-specified operating conditions, such as notch settings, temperatures, and/or pressures specified via an input device, such as a keyboard accessible from the cab of locomotive 200 or a remote transmitter.

Controller 210 may perform control functions in addition to those related to APU exhaust. For instance, via thermostatic elements and heating elements, controller 210 may maintain a coolant temperature and/or lube oil temperature of primary engine 140 above respective predetermined temperatures.

Controller 210 may start APU 110 based on other detected conditions. For instance, controller 210 may start APU 110 based on ambient temperature. APU 110 may be run when primary engine 140 is running or not running. APU exhaust may be prevented from entering air intake system 160 when primary engine 140 is running or not running, such as via a diverter valve.

In a particular embodiment, heat from exhaust of APU 110 is used to keep primary engine 140 warm when primary engine 140 is not running. Because exhaust heat is captured, the thermal efficiency of the APU engine increases.

Figure 3:
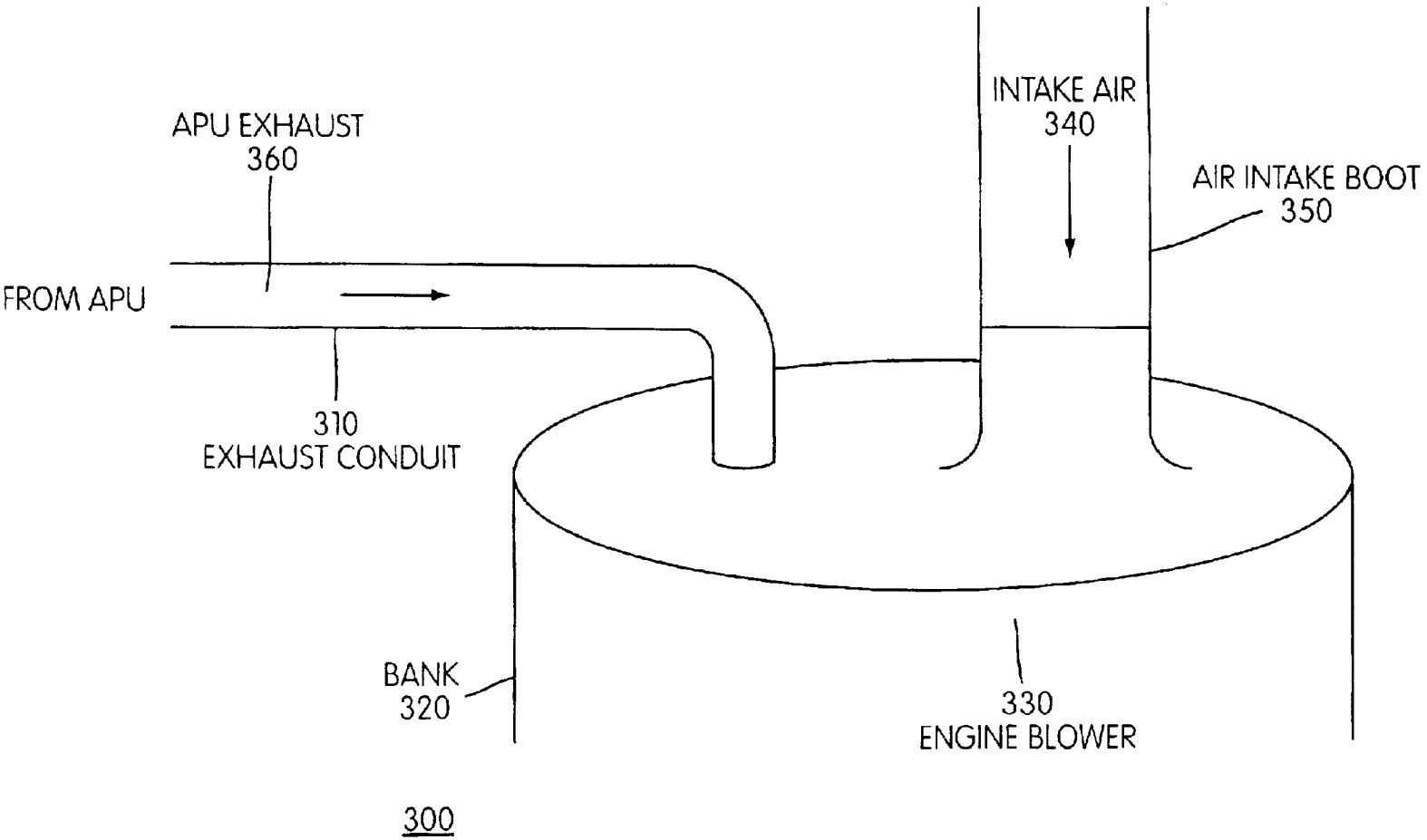
FIG. 3 illustrates an arrangement including an auxiliary power unit (APU) exhaust conduit and a bank of an engine according to an embodiment of the present invention.

FIG. 3 illustrates an arrangement 300 according to an embodiment of the present invention. Arrangement 300 includes an APU exhaust conduit 310 and a bank 320 of an air intake system of a primary engine of a locomotive, such as locomotive 100 and 200 of FIGS. 1 and 2, respectively.

Bank 320 includes an air intake boot 350 and an engine blower 330. Air intake boot 350 is a conduit for intake air 340, which may originate outside the locomotive. Engine blower 330 draws intake air 340 into bank 320 to affect a combustion process operative in the primary engine.

APU exhaust conduit 310 is mechanically coupled to bank 320 of the primary engine. APU exhaust conduit 310 may include one or more members, such as rigid or flexible pipes, hoses, and ducts. APU exhaust conduit 310 conveys APU exhaust 360 from an APU, such as APU 110 described above, to bank 320. APU exhaust 360 is drawn into bank 320 by engine blower 330, and affects a combustion process operative in the primary engine. It is to be appreciated that the form of the components of arrangement 300 shown in FIG. 3 is merely illustrative.

Figure 4:
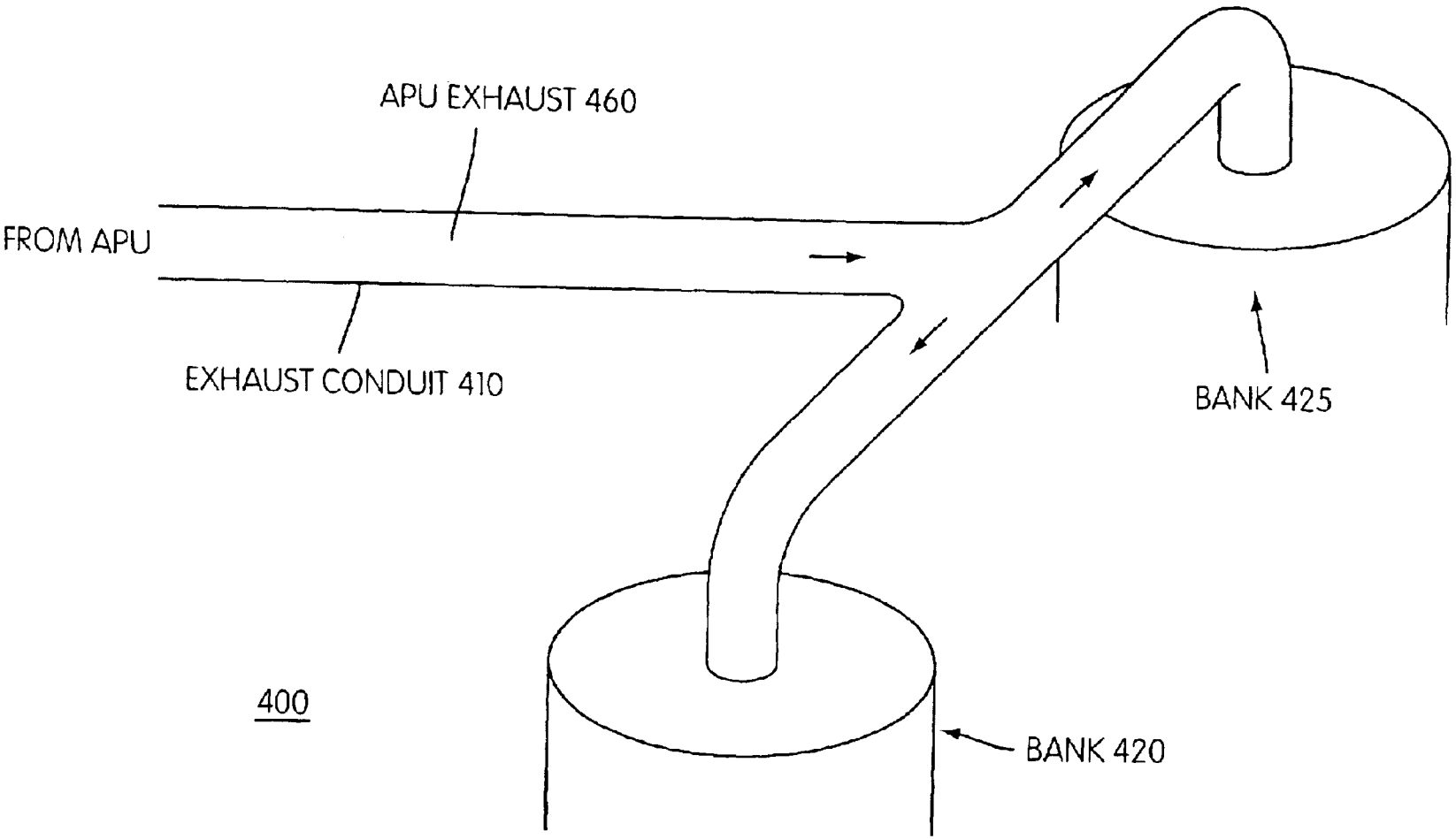
FIG. 4 illustrates an arrangement including an APU exhaust conduit and two banks of an engine according to an embodiment of the present invention.

FIG. 4 illustrates an arrangement 400 according to an embodiment of the present invention. Arrangement 400 includes an APU exhaust conduit 410 and two banks 420, 425 of an air intake system of a primary engine of a locomotive, such as locomotive 100 and 200 of FIGS. 1 and 2, respectively. Although not shown in FIG. 4, banks 420, 425 also may include conduits that convey intake air originating outside the locomotive into the primary engine. As shown in FIG. 4, APU exhaust conduit 410 is T-shaped. Top ends of the T are curved and mechanically coupled to banks 420, 425. Accordingly, APU exhaust 460 is substantially evenly divided into respective exhaust streams, which are respectively directed into banks 420, 425. It is to be appreciated that the form of the components of arrangement 400 shown in FIG. 4 is merely illustrative. Moreover, in certain settings, an even division of APU exhaust into separate streams may not be practicable or desirable. For example, in a skipfiring setting, in which a primary engine is run on only one bank of cylinders, a substantial amount of APU exhaust may be used to keep that bank warm in order to facilitate starting of the primary engine.

Figure 5:
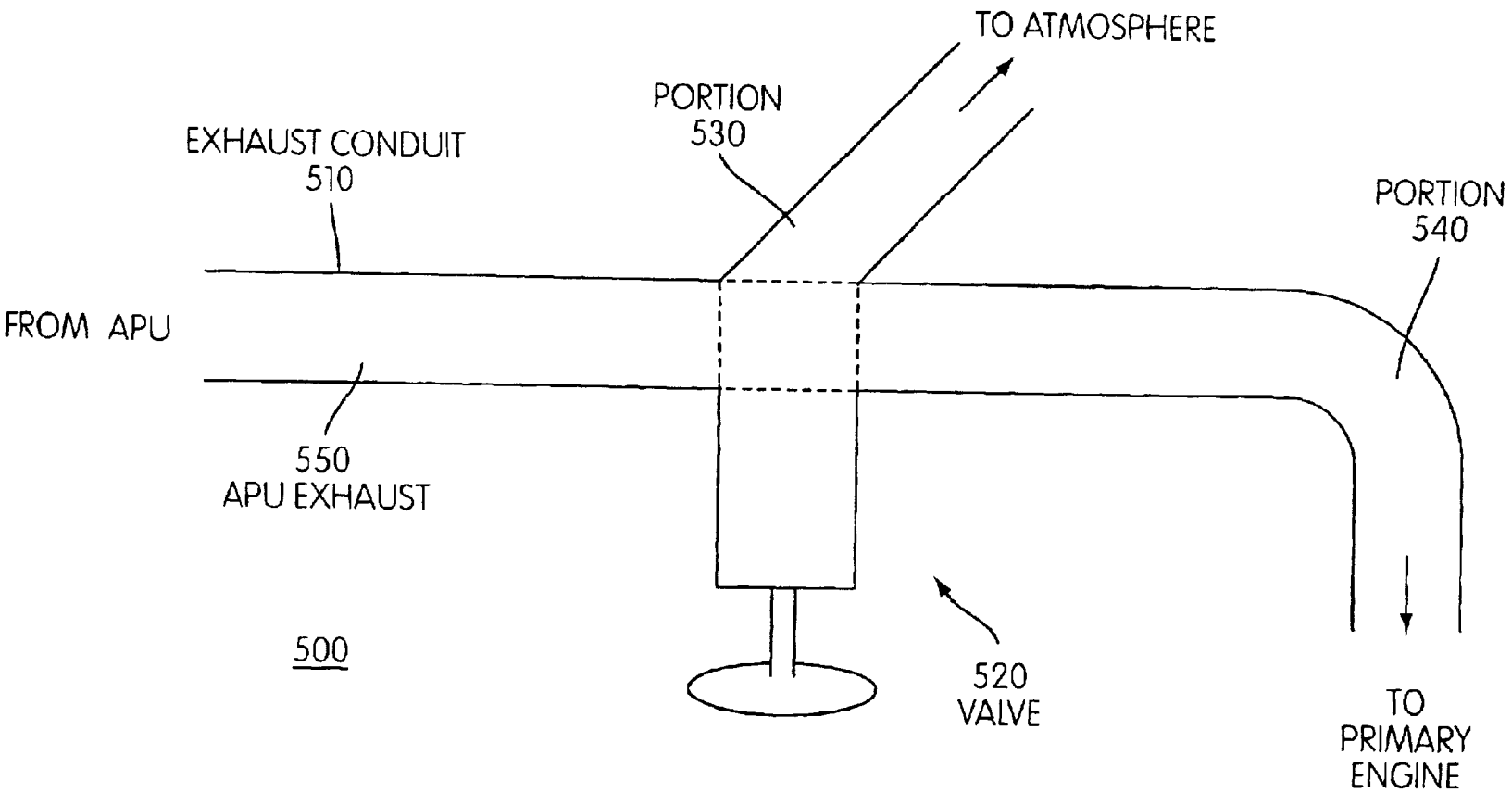
FIG. 5 illustrates an APU exhaust arrangement according to an embodiment of the present invention.

FIG. 5 illustrates an APU exhaust arrangement 500 according to an embodiment of the present invention. Arrangement 500 includes an exhaust conduit 510 and a valve 520. Exhaust conduit 510 directs APU exhaust 550 from an APU to the atmosphere and/or an air intake system of a primary engine of a locomotive. As shown in FIG. 5, exhaust conduit 510 has a portion 530 that directs APU exhaust 550 into the atmosphere and a portion 540 that directs APU exhaust 550 into the primary engine. Valve 520 variably controls the amounts of APU exhaust 550 respectively directed to portion 530 and portion 540. For example, valve 520 may direct that all APU exhaust is directed into portion 540 and that none is directed, or that fractions of APU exhaust are respectively directed into portions 530 and 540. A controller such as controller 210 described above may control valve 520. In some embodiments, valve 520 may be controlled by hand, such as by a rotatable handle connected to valve 520.

Figure 6:
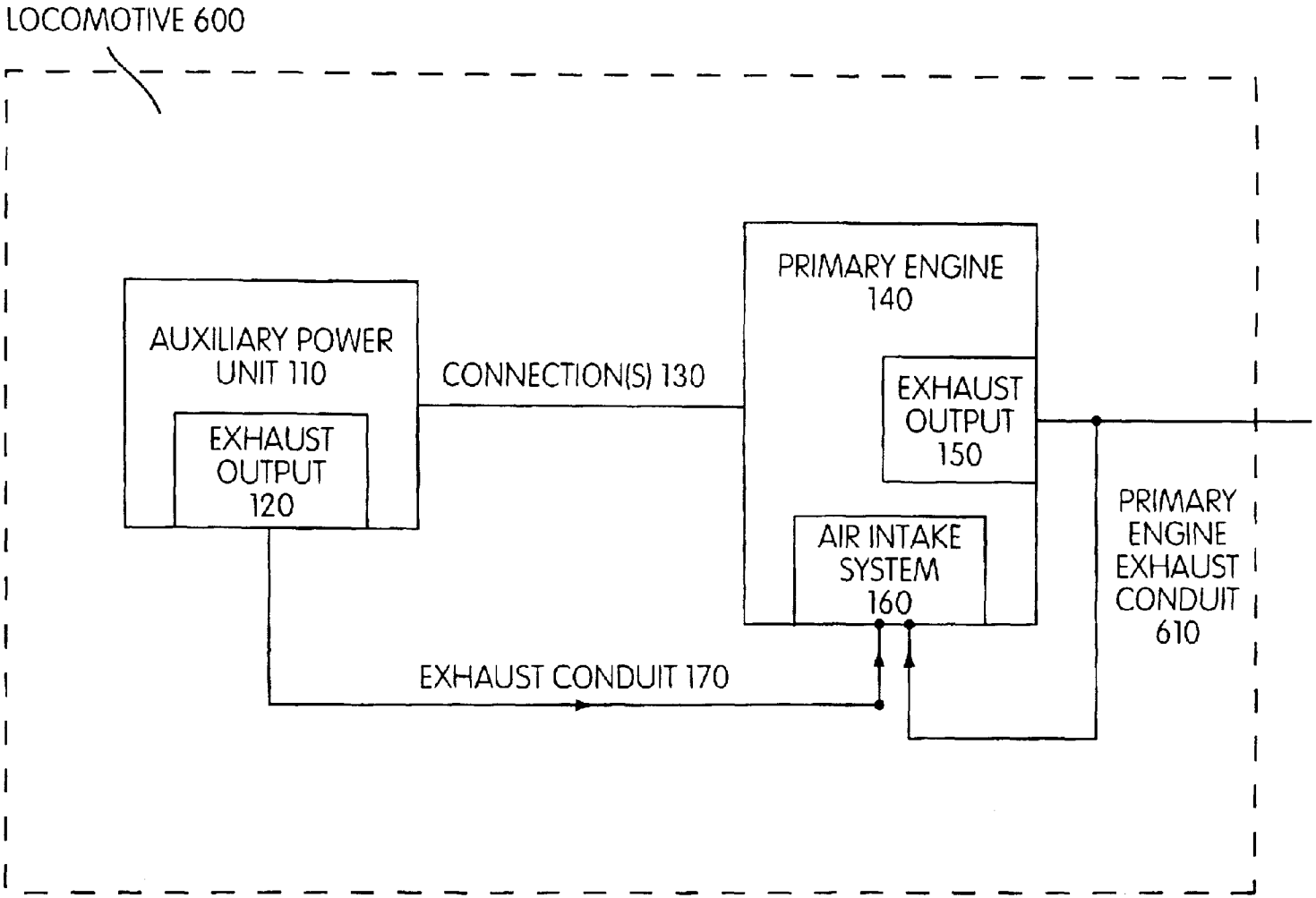
FIG. 6 is a block diagram of a locomotive according to an embodiment of the present invention.

FIG. 6 is a block diagram of a locomotive 600 according to an embodiment of the present invention. Locomotive 600 is similar to locomotive 100 described above in FIG. 1. In addition to APU 110, primary engine 140, connection(s) 130, and APU exhaust conduit 170, locomotive 600 includes a primary engine exhaust conduit 610.

Primary engine exhaust conduit 610 is mechanically coupled to exhaust output 150 and air intake system 160 of primary engine 140. In particular, primary engine exhaust conduit 610 may include a pipe coupled to a muffler (not shown) of primary engine 140. Primary engine exhaust conduit 610 directs at least a portion of exhaust produced by primary engine 140 back into air intake system 160 to affect a combustion process operative in primary engine 140. As such, air intake system 160 receives recirculated exhaust from APU 110 and primary engine 140, respectively. Air intake system 160 may also receive air from the atmosphere. Using one or more valves, a controller may control the relative quantities of air, APU exhaust, and/or primary engine exhaust that enter air intake system 160.

In related embodiments, exhaust from primary engine 140 may be cooled for all or certain operating conditions before being directed back into air intake system 160. For instance, a water-cooled exhaust manifold, conduit, and heat exchanger may be provided for primary engine 140. As such, heat from the exhaust may be transferred to water of primary engine 140.

Figure 7:
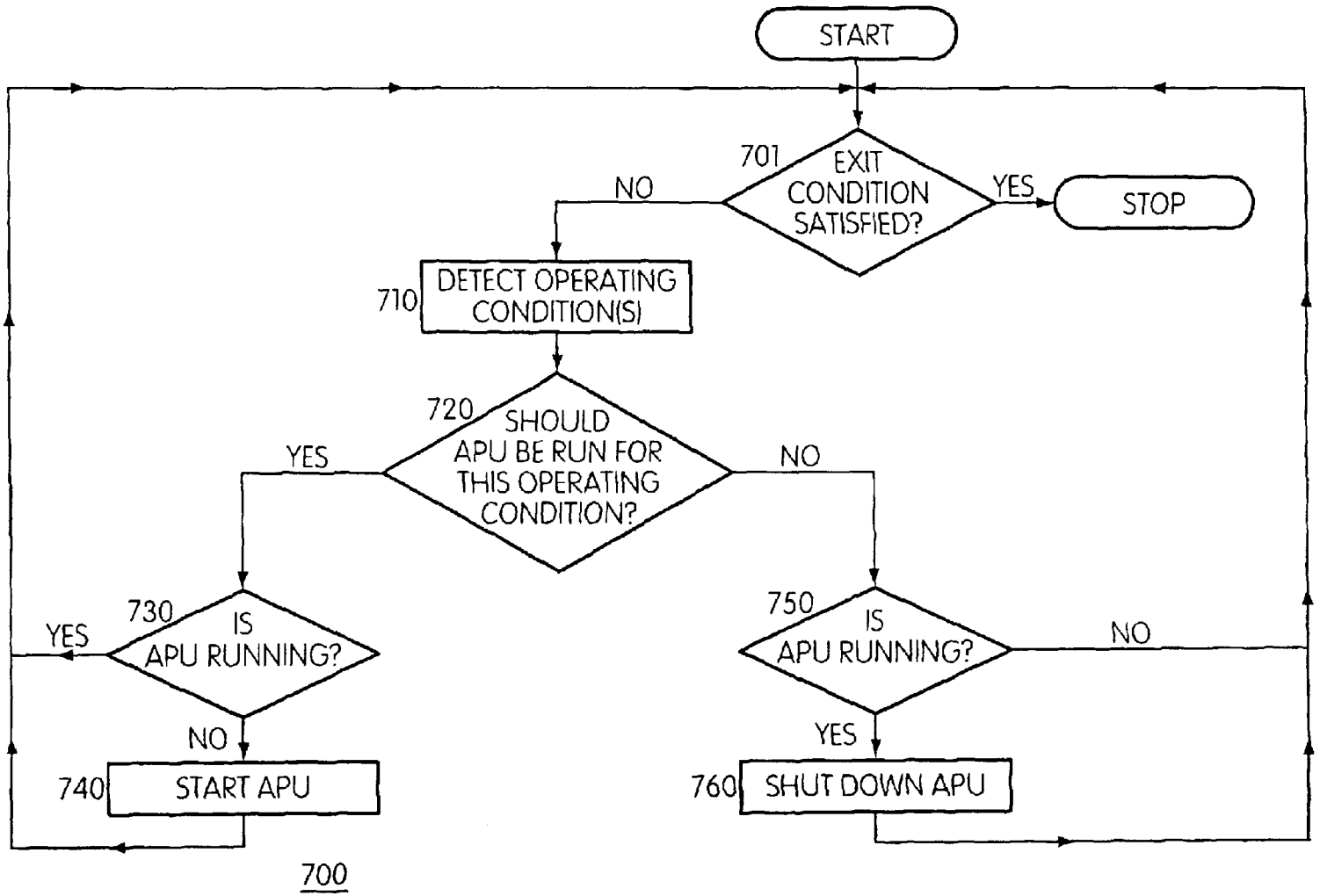
FIG. 7 is a flowchart of a process according to an embodiment of the present invention.

FIG. 7 is a flowchart of a process 700 according to an embodiment of the present invention. Process 700 may be employed by a controller, such as controller 210 in FIG. 2 above, to cycle an APU on and off based on one or more current operating conditions of a primary engine of a locomotive. In task 701, the process tests whether an exit condition is satisfied. Exemplary exit conditions may be that the locomotive is stopped and/or the primary engine is not running, and/or that APU exhaust is to be directed into the primary engine at all times. If an exit condition is satisfied, the process completes. If an exit condition is not satisfied, the process proceeds to task 710, where current operating condition(s), such as a current notch setting, temperature, or pressure of the primary engine, are detected. In task 720, the process tests whether the APU should be run for the current operating condition (i.e., whether, for this condition, the directing of APU exhaust into the primary engine has been determined to reduce emission levels or otherwise enhance performance of the primary engine and/or the APU). Information concerning operating conditions for which the APU should be run may be stored in a memory, entered via a user input device, hardwired in a circuit, etc.

If the APU should be run for the current condition, then in task 730, the process tests whether the APU is already running. If the APU is running, then the process returns to task 701. If not, then in task 740, the APU is started, and the process then returns to task 701. If the test in task 720 determines that the APU should not be run for the current condition, then in task 750, the process tests whether the APU is running. If the APU is not running, then the process returns to task 701. If the APU is running, then the APU is shut down, and the process then returns to task 701.

It is to be understood that process 700 may be used in conjunction with other schemes for controlling an APU and/or primary engine. Further, logic of process 700 may be incorporated into one or more larger processes that control an APU and/or primary engine.

The foregoing description of embodiments is provided to enable any person skilled in the art to make or use embodiments of the present invention. Various modifications to these embodiments are possible, and the generic principles presented herein may be applied to other embodiments as well. For instance, embodiments may be applied in line-haul, switcher, passenger, or road locomotive contexts.

Additionally, embodiments herein may be applied in conjunction with other apparatus and methods, such as other technologies for reducing engine emissions and/or improving engine performance. Moreover, embodiments herein are not limited to locomotive contexts, and may be employed in other contexts, such as stationary power generation, marine and shipping industries, and large off-road trucks, e.g., trucks having at least about 1000 HP.

As such, the present invention is not intended to be limited to the embodiments shown above but rather is to be accorded the widest scope consistent with the principles and novel features disclosed in any fashion herein.

What is claimed is:

1. A method for a locomotive, comprising:

selectively operating an auxiliary power unit (APU) associated with a primary engine of a locomotive; and directing at least a portion of exhaust from the APU into an air intake system of the primary engine, wherein the APU is selectively operated based at least in part on a current operating condition of the locomotive and wherein the directing APU exhaust includes:

pushing the APU exhaust toward the air intake system, by an engine of the APU; and vacuuming the rushed APU exhaust into the air intake system, by at least one suction mechanism of the air intake system.

2. The method of claim 1, wherein the selectively operating the APU includes stopping the APU if the current operating condition does not conform to a predetermined operating condition.

3. The method of claim 1, wherein the current operating condition includes a throttle setting.

4. The method of claim 1, wherein the current operating condition includes a temperature or pressure.

5. The method of claim 1, wherein the APU includes a 40 horsepower (HP) engine.

6. The method of claim 1, wherein the selectively operating the APU includes starting the APU if the current operating condition conforms to a predetermined operating condition.

7. The method of claim 6, wherein the predetermined operating condition is associated with an emissions reduction criterion.

8. The method of claim 1, wherein the APU exhaust is directed into a first bank and a second bank of the air intake system.

9. The method of claim 8, wherein the APU exhaust is substantially evenly divided into respective exhaust streams, the exhaust streams being respectively directed into the first and second banks.

10. The method of claim 1, further comprising directing primary engine exhaust into the air intake system.

11. The method of claim 10, further comprising cooling the primary engine exhaust before directing the primary engine exhaust into the air intake system.

12. The method of claim 1, further comprising directing at least a portion of air from an atmosphere surrounding the locomotive into the air intake system.

13. The method of claim 12, wherein the air intake system receives about 10 percent APU exhaust and 90 percent air.

14. The method of claim 1, further comprising shutting down the primary engine after a predetermined time period of idling of the primary engine.

15. The method of claim 14, wherein the shutting down the primary engine depends upon at least one predetermined condition.

16. The method of claim 15, further comprising warming the shut-down primary engine with at least a portion of the APU exhaust.

17. The method of claim 16, wherein a selected bank of the primary engine is warmed with the APU exhaust.

18. A method for a locomotive, comprising:

operating a primary engine of a locomotive;

simultaneously operating an auxiliary power unit (APU) associated with the primary engine;

while simultaneously operating the APU, directing at least a portion of the exhaust from the APU into an air intake system of the primary engine; and wherein the directing APU exhaust includes:

pushing the APU exhaust toward the air intake system, by an engine of the APU; and vacuuming the pushed APU exhaust into the air intake system, by at least one suction mechanism of the air intake system.

19. The method of claim 18, wherein the APU is selectively operated.

20. The method of claim 19, wherein the APU is selectively operated based at least in part on a current operating condition of the locomotive.

21. The method of claim 18, wherein the APU exhaust is selectively directed into the air intake system.

22. The method of claim 21, wherein the APU exhaust is selectively directed into the air intake system based at least in part on a current operating condition of the locomotive.

23. A system for a locomotive, comprising:

an auxiliary power unit (APU) constructed and arranged to be used in cooperation with a primary engine of a locomotive, the APU producing an exhaust stream and being operated simultaneously with the primary engine;

at least one conduit between the APU and an air intake system of the primary engine, wherein the conduit conveys APU exhaust into the air intake system; and a controller configured to selectively activate the APU wherein the conveyance of the APU exhaust includes pushing the APU exhaust toward the air intake system, by an engine of the APU and vacuuming the pushed APU exhaust into the air intake system, by at least one suction mechanism of the air intake system.

24. The system of claim 23, wherein the at least one conduit includes a pipe.

25. The system of claim 23, wherein the APU includes a 40 horsepower (HP) engine.

26. The system of claim 23, wherein the controller is integrated within the APU.

27. The system of claim 23, wherein the controller is configured to shut down the primary engine after a predetermined time period of idling of the primary engine.

28. The system of claim 23, wherein the controller is configured to start the secondary engine responsive to a predetermined ambient temperature.

29. The system of claim 23, wherein the APU is configured to generate power for at least one device external to the primary engine.

30. The system of claim 23, wherein the APU is selectively activated based at least in part on a current operating condition of the locomotive.

31. The system of claim 30, wherein an operating condition includes a throttle setting.

32. The system of claim 23, wherein the air intake system comprises a first bank and a second bank, the first and second banks each receiving a respective portion of the APU exhaust.

33. The system of claim 32, wherein the respective portions are substantially equal.

34. The system of claim 32, wherein the first bank receives substantially all of the APU exhaust.

35. The system of claim 23, wherein the controller is configured to selectively direct APU exhaust into the air intake system.

36. A The system of claim 35, further comprising a valve connected to the at least one conduit, the valve adjustably controlling an amount of APU exhaust directed into the air intake system.

37. The system of claim 36, wherein the controller is configured to control the valve.

38. A system for a locomotive, comprising:

means for generating auxiliary power for a primary engine of a locomotive, the power generating means producing an exhaust stream and being simultaneously operated with the primary engine;

means for directing at least a portion of the exhaust from the power generating means into an air intake system of the primary engine; and means for selectively activating the power generating means wherein the direction of at least a portion of the exhaust includes pushing the exhaust toward the air intake system, by an engine included in the means for generating auxiliary power and vacuuming the pushed exhaust into the air intake system, by at least one suction mechanism of the air intake system.

39. The system of claim 38, wherein the power generating means are selectively activated based at least in part on a current operating condition of the locomotive.

40. The system of claim 38, wherein the power generating means comprise an auxiliary power unit (APU).

41. The system of claim 40, wherein the APU is configured to generate power for at least one device external to the primary engine.

42. The system of claim 38, wherein the at least a portion of the exhaust is selectively directed into the air intake system.

43. The system of claim 38, wherein the exhaust directing means include a pipe.

44. A diesel-electric locomotive, comprising:

a plurality of wheels;

a primary engine coupled to a fuel tank, the primary engine having an air intake system;

an electrical generator coupled to and driven by the primary engine;

a plurality of motors coupled to the electrical generator and to the wheels, the motors constructed and arranged to drive the wheels;

an auxiliary power unit (APU) coupled to the primary engine by at least one conduit between the APU and the air intake system, the APU producing an exhaust stream and being operated simultaneously with the primary engine, wherein the conduit conveys APU exhaust into the air intake system; and a controller configured to selectively activate the APU, wherein the conveyance of the APU exhaust includes pushing the APU exhaust toward the air intake system, by an engine of the APU and vacuuming the pushed APU exhaust into the air intake system, by at least one suction mechanism of the air intake system.

45. The locomotive of claim 44, wherein the locomotive is used for switching operations.

* * * * *